United States Patent [19]

Gardner et al.

[11] 4,106,702

[45] Aug. 15, 1978

[54] FUEL INJECTION NOZZLE TIP WITH LOW VOLUME TAPERED SAC

[75] Inventors: John W. Gardner, Chillicothe; William A. Grgurich; Albert B. Niles, both of Peoria, all of Ill.

[73] Assignee: Caterpillar Tractor Co., Peoria, Ill.

[21] Appl. No.: 788,870

[22] Filed: Apr. 19, 1977

[51] Int. Cl.[2] ..... F02M 61/10; B05B 1/30

[52] U.S. Cl. ..... 239/533.3; 239/584

[58] Field of Search ..... 239/533.2, 533.3, 533.4, 239/533.5, 533.6, 533.7, 533.8, 533.9, 533.11, 533.12, 584, 585

[56] References Cited

U.S. PATENT DOCUMENTS

| | | | |
|---|---|---|---|
| 2,699,358 | 1/1955 | Soderegger | 299/107.6 |
| 2,927,737 | 3/1960 | Zeuch et al. | 239/533.3 |
| 3,612,407 | 10/1971 | Itano | 239/533.3 |
| 3,836,080 | 9/1974 | Butterfield et al. | 239/533.4 |
| 3,980,237 | 9/1976 | Parrish, Jr. | 239/533.3 |

FOREIGN PATENT DOCUMENTS

| | | | |
|---|---|---|---|
| 502,540 | 11/1954 | Italy | 239/533.3 |
| 565,299 | 11/1944 | United Kingdom | 239/584 |

*Primary Examiner*—Robert W. Saifer

*Attorney, Agent, or Firm*—Wegner, Stellman, McCord, Wiles & Wood

[57] ABSTRACT

A fuel injector including a hollow nozzle having a spray tip with at least one interior conical surface with an apex terminating in a spherical surface, a plurality of injection openings in the nozzle tip and extending from the interior conical surface and/or spherical surface on extended radii of the spherical surface, the extremities of the openings remote from the spherical surface defining a plane, and a reciprocal valve within the nozzle and having a frusto-conical valve tip terminating in a flat end and seatable against the interior conical surface, the interior conical surface and the frusto-conical valve tip being constructed and arranged such that when the valve tip seats against the interior conical surface, the flat end will lie substantially in the plane defined by the extremities of the openings.

9 Claims, 7 Drawing Figures

FUEL INJECTION NOZZLE TIP WITH LOW VOLUME TAPERED SAC

BACKGROUND OF THE INVENTION

This invention relates to nozzle constructions for fuel injectors.

Increasing concern in recent years over emissions from internal combustion engines has led to substantial re-evaluation of nozzle constructions for fuel injectors. Many fuel injectors have substantial so-called "sac" volumes within their nozzle tips. During the engine cycle, a small amount of fuel remains within the sac volume in the nozzle tip. During the latter stages of the combustion process, such fuel is vaporized but is in a sufficient quantity that it does not participate in the combustion process. As a consequence, it is emitted from the engine as a hydrocarbon emission.

As a consequence of the relatively high emissions of such constructions, so-called zero sac fuel injection nozzles have come into vogue. In such nozzles, a valve member typically is located on the exterior of the nozzle and seals against the injection opening from the exterior thereof after the injection process has been completed. As a result, there is no sac volume exposed to the hot gases of combustion to be vaporized and emitted.

While zero sac nozzles have been successful in eliminating or reducing hydrocarbon emissions, in most instances, their life is not as long as that of nozzles having a sac volume. Specifically, in nozzles having a sac volume, the evaporation of fuel from the sac volume cools the nozzle, thereby preventing oxidation of nozzle parts and minimizing the formation of lacquer on the valve components which would interfere with fuel delivery and sealing qualities.

SUMMARY OF THE INVENTION

The present invention is directed to overcoming one or more of the problems as set forth above.

According to the present invention, there is provided, in a fuel injector, the combination of a hollow nozzle having a spray tip with an interior conical surface terminating in a spherical surface. At least one injection opening is disposed in the nozzle tip and is located on the radius of the spherical surface. A reciprocal valve is disposed within the nozzle and has a frusto-conical tip within the interior conical surface. The frusto-conical tip is sealingly engageable with the interior conical surface and the end of the valve tip, when the tip is seated on the interior conical surface, is disposed at about the level of the adjacent side of the injection opening at the interior surface.

Other objects and advantages of the invention will become apparent from the following specification taken in connection with the accompanying drawings.

DESCRIPTION OF THE PREFERRED EMBODIMENT

Figure 1:
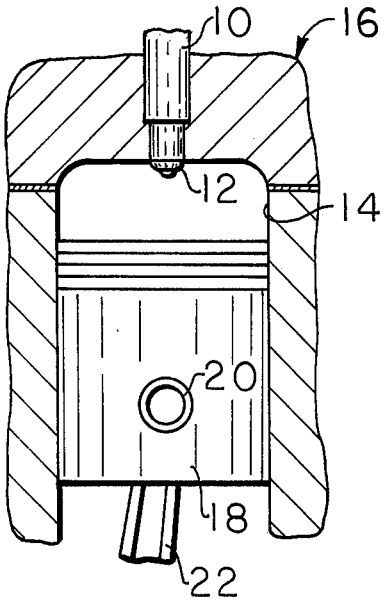
FIG. 1 is a somewhat schematic view of a part of an internal combustion engine employing a fuel injector made according to the invention.

An exemplary embodiment of a fuel injector made according to the invention is designated 10 and includes a nozzle 12 disposed within the cylinder 14 of an internal combustion engine, generally designated 16. The engine includes a reciprocating piston 18 connected by a wrist pin 20 to a connecting rod 22 which extends to a crank shaft in a conventional fashion. It is to be observed that while the nozzle 10 herein is shown to be employed with a reciprocating engine, it can be advantageously employed with rotary engines as well. Moreover, in some instances it may be utilized in applications other than engines.

Figure 2:
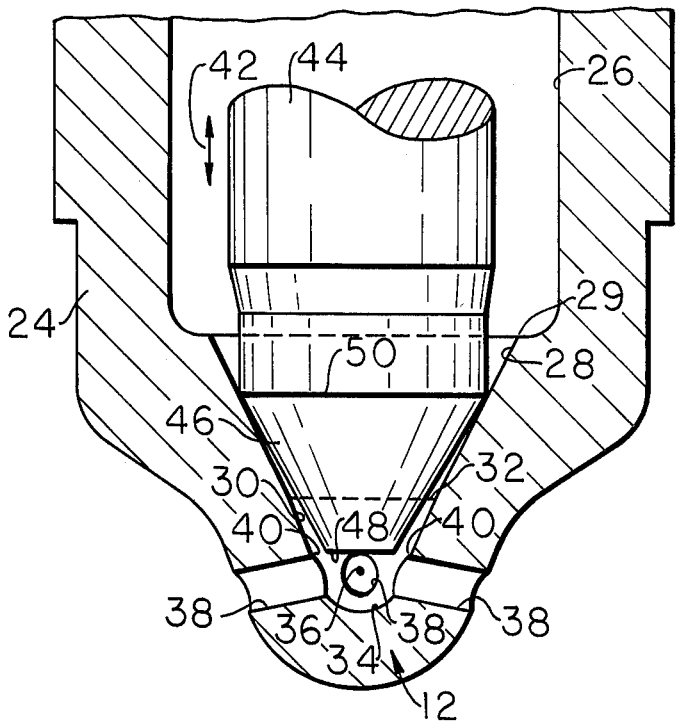
FIG. 2 is an enlarged, sectional view of a fuel injector in the closed position having a nozzle embodying the invention.

Turning now to FIG. 2, the fuel injector 10 is seen to include a barrel 24 having a hollow interior 26 through which fuel may flow and terminating in the tip 12. The interior surface of the tip 12 is in fluid communication with the bore 26 and is defined by first and second frusto-conical surfaces 28, 30. The first frusto-conical surface 28 has a major base 29 which, in the embodiment illustrated, defines a plane perpendicular to its imaginary axis. The first frusto-conical surface 28 has a minor base which is common with the major base of the second frusto-conical surface 30, the two meeting at a line of delineation or circular juncture 32. The slope of the first frusto-conical surface 28 is less than that of the second frusto-conical surface 30, in the illustrated embodiment, by a small amount.

The minor base of the second frusto-conical surface joins to a partial spherical surface 34 having its center at a point 36.

The tip 12 is provided with a plurality of cylindrical spray openings 38 each having its cylindrical axis disposed on an extension of a radius of the spherical surface 34. That is, the cylindrical axes of the openings 38 intersect the center point 36. Thus the openings 38 are located so their upper portions intersect the second frusto-conical surface 30 and define points 40 which are most remote from the spherical surface 34. Points 40 are located in a common plane which, in the configuration illustrated in FIG. 2, is transverse to the longitudinal axis of the barrel 24.

Disposed within the barrel 24 for reciprocation in the direction of an arrow 42 by conventional means, not shown, is a valve 44 provided with a frusto-conical tip 46 terminating in a flat surface 48. The surface of frusto-conical tip 46 is less steep than frusto-conical surface 28. More particularly, angle A, the angle of intersection of frusto-conical surface 28 with plane 29, is greater than angle B, the angle of intersection of fursto-conical tip surface 46 with its major base 50. The difference between angle A and angle B, in the embodiment shown, is 1°; however it is preferably no greater than about 1°30′ nor less than 0°15′. In other words, the included angles at the imaginary apex of the frusto-conical tip 46 is in the range of 0°30′ to 3° greater than the included angle at the imaginary apex of frusto-conical surface 28. This difference between the included angles of tip 46 and first frusto-conical surface 28 ensures that the frusto-conical tip 46 will sealingly engage against the first frusto-conical surface 28 at the major base 50 of the tip 46. As a consequence, sealing contact will be over a greater area, due to the larger periphery of tip 46 at its major base 50 so that contact stresses are minimized to thereby reduce wear of the valve components at the seat.

It is to be particularly observed that when the valve 44 is seated against the first frusto-conical surface 28, the flat surface 48 on the end of the tip 46 lies in the plane defined by the points of emergence 40 of the openings 38 into the interior of the nozzle. In this respect, the aforementioned dimensioning of the divergence between the tip 46 and the first frusto-conical surface 28 assures that the flat tip 48 will be so located even after extended use.

The foregoing construction and arrangement of the various parts provides a fuel injector having a very low sac volume. For example, it is contemplated that the total sac volume may be on the order of 0.24 cubic millimeters. Thus, the quantity of fuel remaining in the sac volume after the injection process is extremely small and, when vaporized, because of the small volume, will be oxidized so that there will be no hydrocarbon emissions. At the same time, the quantity is sufficient to cool the tip 12 and prevent oxidation thereof by hot combustion gases as well as to minimize lacquering of the valve components.

A salient feature of the embodiment is that the end 48 is relatively blunt rather than pointed and that the same is not located in partial obstruction to the openings 38 when the valve 44 is seated. The blunt construction enables the attainment of very low sac volumes, thereby substantially reducing hydrocarbon emissions. Locating the end 48, when the valve is seated, at the point mentioned above, precludes any part of the valve tip 46 interfering with fuel flow characteristics when the valve 44 is first cracked as would be the case if the end 48 extended below the plane defined by the points 40 when the valve 44 is seated. This advantage also occurs when the valve is moved towards its closed position.

Figure 3:
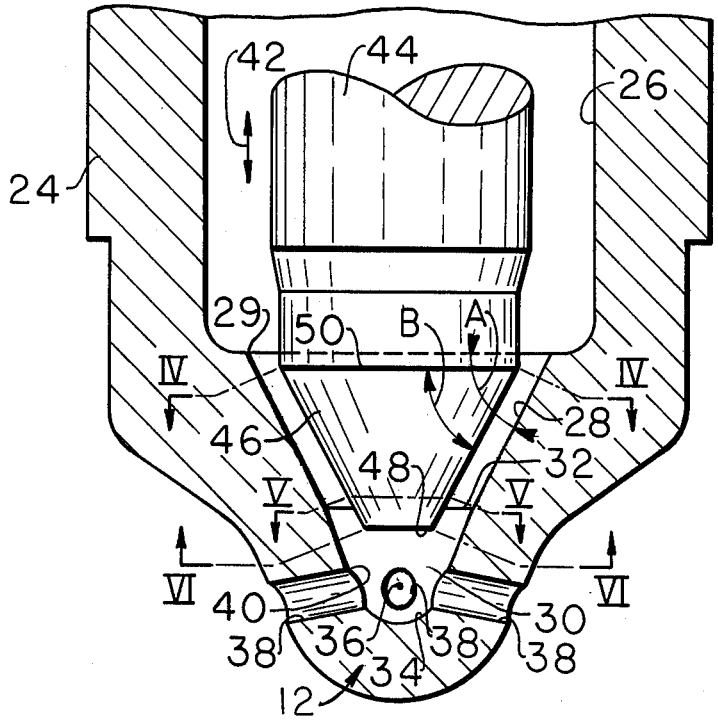
FIG. 3 is an enlarged view of the lower end of the fuel nozzle showing the nozzle in the open position.
Figure 4:
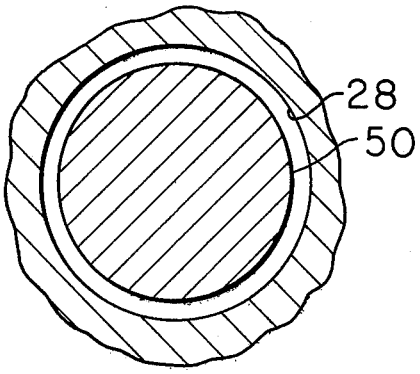
FIG. 4 is a sectional view taken along line 4—4 of FIG. 3.
Figure 5:
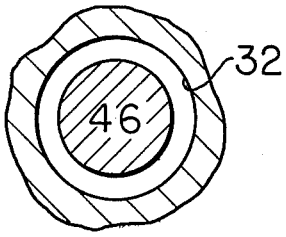
FIG. 5 is a sectional view taken along line 5—5 of FIG. 3.
Figure 6:
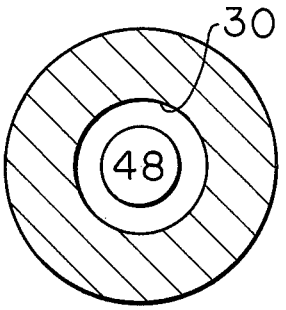
FIG. 6 is a sectional view taken along line 6—6 of FIG. 3.

Referring to FIG. 3, there is shown the reciprocal valve 44 in open position at which the blunt end 48 of the valve tip 46 is adjacent, but at a level below the circular juncture 32. In this position, major base 50 of the tip 46 is closely adjacent but at a level below the major base 29 of frusto-conical surface 28. As can be seen by comparing FIGS. 4–6, the minimum fuel flow area (FIG. 5) occurs at the edge 32 which may be termed a control edge. Control of the movement of the reciprocal valve 44 controls the fuel flow area. In accordance with the illustrated embodiment of the present invention, the circular juncture 32 of the two interior frusto-conical surface 28 and 30 provides the above-mentioned control edge. This edge results from the structure which provides the minimum sac area previously described and allows simplification of the construction of the valve 44. Thus, the frusto-conical valve tip 46 is simply and economically manufactured, takes on a more simplified form than that of the prior art, cooperates with the nozzle to keep the sac to minimum volume and also provides control of the fuel flow area.

Figure 7:
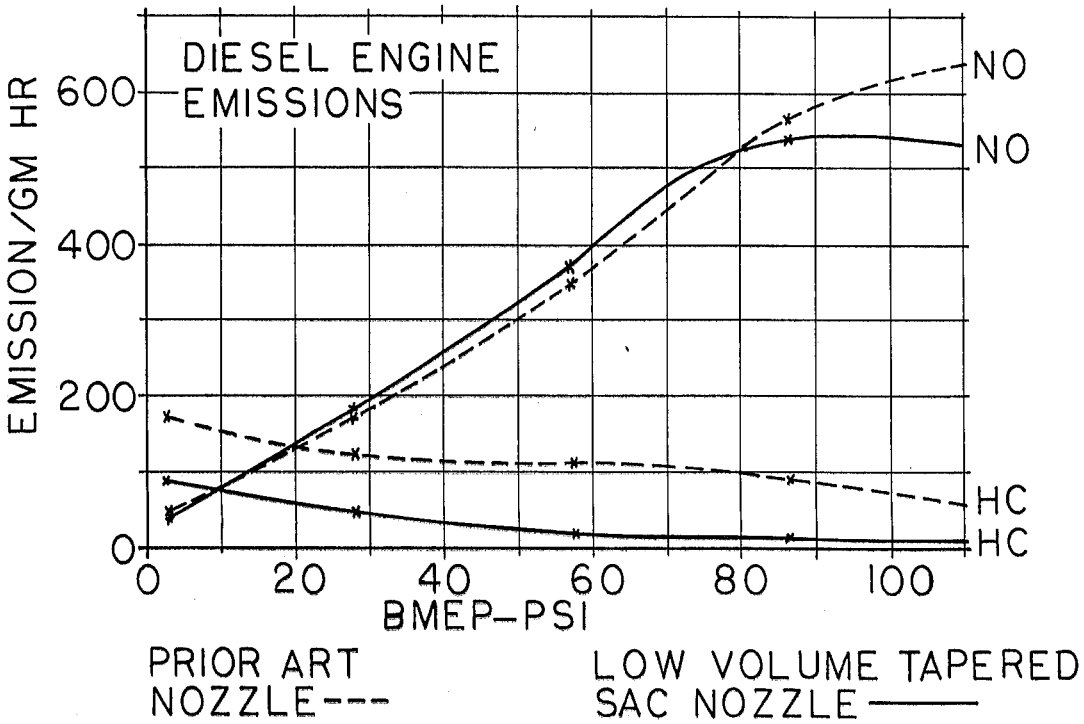
FIG. 7 is a comparative chart showing emissions of engines using a prior art nozzle versus the nozzle of the present invention in gm/hr at various BMEP.

FIG. 7 illustrates a comparison of the emission levels in grams per hour for nitrous oxides and hydrocarbons at various brake mean effective pressures (BMEP) in pounds per square inch in diesel engines employing fuel injectors made according to the prior art versus fuel injectors made according to the present invention. The prior art nozzle utilized was a conventional, commercially obtainable, nozzle known as a stepped sac construction having a sac length (the distance from the point of minimum flow area and corresponding to the edge 32 to the bottom of the internal cavity of the spray tip), an included angle of 150°–155° between the axes of the spray openings, a sac diameter of 0.051 inches at the widest part of the sac and a sac diameter of 0.042 inches at the narrowest cylindrical portion of the sac resulting in an interior portion spherical surface in the tip having a radius of 0.21 inches. Spray opening length was 0.021 inches. The total sac volume was 1.28 cubic millimeters.

The nozzle made according to the present invention utilized the same number of spray openings as the prior art construction and had a sac length of 0.036 inches, an included angle between the axis of the spray openings of 155°, a partial spherical surface in the tip of the nozzle having a radius of 0.016 inches and a spray opening length of 0.021 inches. The total sac volume was 0.24 cubic millimeters.

As can be seen from FIG. 7, nitrous oxide emissions at BMEP's of 85 psi or below were substantially identical for both constructions. At BMEP's of 85 and above, a nozzle made according to the invention produced lesser nitrous oxide emissions.

With respect to hydrocarbon emissions, for all BMEP's measured, the nozzle made according to the present invention produced significant reductions. At extremely low BMEP pressures, hydrocarbon emissions were reduced by 50%, while for BMEP pressures from about 30–60 psi, greater reductions were achieved, being on the order of 80–90%, the hydrocarbon emission reduction was on the order of 80% and even at BMEP pressures in excess of 100 psi, reductions in excess of 50% were obtained.

Carbon monoxide emissions increased somewhat when the nozzle of the present invention is used over prior art constructions but remained quite tolerable within limits presently established by emission control standards.

The embodiments of the invention in which an exclusive property or privelege is claimed are defined as follows:

1. In a fuel injector, the combination of:

a hollow nozzle having a spray tip with a stepped, interior conical surface defined by first and second generally frusto-conical surfaces sharing a common base which defines a circular juncture with the second frusto-conical surface being steeper than the first frusto-conical surface, said spray tip further including an interior, partially rounded surface extending from the minor base of said second frusto-conical surface;

at least one injection opening in said nozzle at the spray tip thereof; and a reciprocal valve within said nozzle and having a frusto-conical valve tip which in a closed position of the valve is seated against said first frusto-conical surface at the major base of said frusto-conical valve tip, said frusto-conical valve tip being less steep than said first frusto-conical surface and terminating in a blunt end which in said closed position is disaligned with said injection opening at the edge thereof remote from the spray tip, the area of said blunt end being a major portion of the cross-sectional area of said interior surface at said edge whereby said valve tip in said closed position occupies substantially the entire volume within said interior surface between said edge and said circular juncture, said reciprocal valve being movable to an open position in which the major base of said frusto-conical valve tip is at a level adjacent the major base of and radially within said first frusto-conical surface, the circular juncture of said first and second frusto-conical surfaces defining an annular control edge on the nozzle which, in cooperation with the frusto-conical surface of the valve tip, defines the minimum fuel flow area therebetween in the open position of the valve, said blunt end being disposed adjacent said circular juncture in said open position, said partially rounded surface comprising a spherical surface, each said injection opening being located on the radius of said spherical surface.

2. The fuel injector of claim 1 wherein the angle of intersection of said second frusto-conical surface with a plane perpendicular to its imaginary axis is greater than the angle of intersection of said frusto-conical valve tip surface with its major base.

3. The fuel injector of claim 2 wherein the difference between said angles is up to about 1°30′.

4. The fuel injector of claim 2 wherein the difference between said angles is in the range of about 0°15′ to 1°30′.

5. In a fuel injector, the combination of:

a hollow nozzle having a spray tip with a stepped, interior conical surface defined by first and second generally frusto-conical surfaces sharing a common base which defines a circular juncture with the second frusto-conical surface being steeper than the first frusto-conical surface, said spray tip further including an interior, spherical surface extending from the minor base of said second frusto-conical surface;

a plurality of injection openings in said nozzle spray tip, each said injection opening being located on a radius of said spherical surface, the extremities of said openings remote from said spherical surface defining a plane; and a reciprocal valve within said nozzle and having a frusto-conical valve tip which in a closed position of the valve is seated against said first frusto-conical surface at the major base of said frusto-conical valve tip, said frusto-conical valve tip being less steep than said first frusto-conical surface and terminating in a blunt end which in said closed position is disaligned with said injection openings at said plane, the area of said blunt end being a major portion of the cross-sectional area of said interior surface at said edge whereby said valve tip in said closed position occupies substantially the entire volume within said interior surface between said plane and said circular juncture, said reciprocal valve being movable to an open position in which the major base of said frusto-conical valve tip is at a level adjacent the major base of and radially within said first frusto-conical surface, the circular juncture of said first and second frusto-conical surfaces defining an annular control edge on the nozzle which, in cooperation with the frusto-conical surface of the valve tip, defines the minimum fuel flow area therebetween in the open position of the valve, said blunt end being disposed adjacent said circular juncture in said open position.

6. In a fuel injector, the combination of:

a hollow nozzle having a spray tip with a stepped, interior conical surface defined by first and second generally frusto-conical surfaces sharing a common base which defines a circular juncture with the second frusto-conical surface being steeper than the first frusto-conical surface, said spray tip further including an interior, partially rounded surface extending from the minor base of said second frusto-conical surface;

a plurality of injection openings in said nozzle spray tip, said injection openings extending from said frusto-conical surface and said rounded surface on lines extending from the geometrical center of said rounded surface, the interior extremities of said openings remote from said spherical surface defining a plane; and a reciprocal valve within said nozzle and having a frusto-conical valve tip which in a closed position of the valve is seated against said first frusto-conical surface at the major base of said frusto-conical valve tip, said frusto-conical valve tip being less steep than said first frusto-conical surface and terminating in a blunt end which in said closed position is disaligned with said injection openings at said plane, the area of said blunt end being a major portion of the cross-sectional area of said interior surface at said plane whereby said valve tip in said closed position occupies substantially the entire volume within said interior surface between said plane and said circular juncture, said reciprocal valve being movable to an open position in which the major base of said frusto-conical valve tip is at a level adjacent the major base of and radially within said first frusto-conical surface, the circular juncture of said first and second frusto-conical surfaces defining an annular control edge on the nozzle which, in cooperation with the frusto-conical surface of the valve tip, defines the minimum fuel flow area therebetween in the open position of the valve, said blunt end being disposed adjacent said circular juncture in said open position.

7. A fuel injector as set forth in claim 6 wherein said frusto-conical valve tip diverges from said first frusto-conical surface at an angle in the range of 2°–3°.

8. A fuel injector as set forth in claim 7 wherein said blunt end of the reciprocal valve is substantially flat.

9. In a fuel injector, the combination of:

a hollow nozzle having a spray tip with a stepped, interior conical surface defined by first and second generally frusto-conical surfaces sharing a common base which defines a circular juncture with the second frusto-conical surface being steeper than the first frusto-conical surface, said spray tip further including an interior, partially rounded surface extending from the minor base of said second frusto-conical surface;

at least one injection opening in said nozzle at the spray tip thereof; and a reciprocal valve within said nozzle and having a frusto-conical valve tip which in a closed position of the valve is seated against said first frusto-conical surface at the major base of said frusto-conical valve tip, said frusto-conical valve tip being less steep than said first frusto-conical surface and terminating in a blunt end which in said closed position is disaligned with said injection opening at the edge thereof remote from the spray tip, the area of said blunt end being a major portion of the cross-sectional area of said interior surface at said edge whereby said valve tip in said closed position occupies substantially the entire volume within said interior surface between said edge and said circular juncture, said reciprocal valve being movable to an open position in which the major base of said frusto-conical valve tip is at a level adjacent the major base of and radially within said first frusto-conical surface, the circular juncture of said first and second frusto-conical surfaces defining an annular control edge on the nozzle which, in cooperation with the frusto-conical surface of the valve tip, defines the minimum fuel flow area therebetween in the open position of the valve, said blunt end being disposed adjacent said circular juncture in said open position.

* * * * *